United States Patent [19]

Bifano et al.

[11] Patent Number: 5,003,743

[45] Date of Patent: Apr. 2, 1991

[54] PANEL SUPPORT MEMBER AND SUPPORT ARRANGEMENT

[75] Inventors: Gabriel F. Bifano, Miami; Erenio Reyes, Hialeah, both of Fla.

[73] Assignee: Vinyl Corporation, Miami, Fla.

[21] Appl. No.: 502,432

[22] Filed: Mar. 30, 1990

[51] Int. Cl.[5] ..... E04B 5/00

[52] U.S. Cl. ..... 52/282; 52/287; 52/764

[58] Field of Search ..... 52/281, 282, 764, 765, 52/235, 34, 264, 265, 287, 288, 471, 482, 726; 403/205, 306, 382, 403

[56] References Cited

U.S. PATENT DOCUMENTS

| | | | |
|---|---|---|---|
| 1,772,694 | 8/1930 | White | 52/764 X |
| 3,494,085 | 2/1970 | Van Bael | 52/287 X |
| 4,189,885 | 2/1980 | Fritz | 52/287 |
| 4,672,787 | 6/1987 | Murphy | 52/764 X |
| 4,733,986 | 3/1988 | Kenning et al. | 403/306 |

*Primary Examiner*—David A. Scherbel

*Assistant Examiner*—Creighton Smith

*Attorney, Agent, or Firm*—Foley & Lardner

[57] ABSTRACT

A construction panel support member for attachment to a building structure in an end-to-end relationship with a second similar support member. The panel support member includes a back flange attachable to the structure, a bottom flange joined to the back flange at substantially 90 degrees, and a side flange joined to the bottom flange. The bottom flange including a top surface adapted to support a construction panel, and the side flange is substantially parallel with the back flange and extends upwardly from the top surface to a top flange. The top flange is substantially parallel to the top surface and extends from the side flange toward the back flange. The side flange includes a ridge which is substantially parallel to the top surface and extends from the side flange toward the back flange such that a groove is formed between the top surface, the ridge, and the side flange. The groove is adapted to accept a support element engageable with the second support member.

28 Claims, 8 Drawing Sheets

PANEL SUPPORT MEMBER AND SUPPORT ARRANGEMENT

BACKGROUND OF THE INVENTION

The present invention relates to construction materials, and, more particularly, to an improved arrangement for positioning and supporting construction panels against the structure of a building.

Referring to FIG. 1, a known arrangement is shown for positioning and supporting construction panels 10 against structural members 12, 13 of a building. Structural members 12, 13 are typically wood framing members such as 2-by-4 or 2-by-6 studs. Lower edges 14 of panels 10 rest upon L-shaped members 16 which are affixed to structural members 13 with fasteners such as nails 18. Panels 10 are affixed to structural members 12 with nails 20. L-shaped members 16 serve to position panels 10 while panels 10 are being nailed in place, and also serve to provide a finished and weatherproof surface for lower edges 14. Subsequent to affixing panels 10 to structural members 12, a surface 22, such as stucco, plaster, concrete or mortar, is applied to panels 10 for purposes of providing the building with a facade.

L-shaped members 16 are typically manufactured from aluminum or plastic, and are provided in sections having lengths of 8, 10, or 12 feet For wall spans greater than the section lengths of L-shaped members 16, a plurality of L-shaped members 16 abutted in end-to-end relationships are necessary. FIG. 2 illustrates an interface surface 24 of L-shaped member 16 upon which lower edge 14 of panel 10 and lower edge 15 of surface 22 rest. At surface 24 it is common for moisture to accumulate, due to condensation between lower edges 14 and 15 and L-shaped member 16, at locations 26 and 28 as illustrated in FIG. 3. Locations 26 and 28 are located near the joint between abutting L-shaped members 16.

The moisture accumulation is normally not a problem unless it freezes. When the moisture freezes, its volume increases as it changes state from a liquid to a solid (ice), the ice causes the corners 30 and 32 of L-shaped members 16 to deform downward as illustrated by the dotted representation of corners 30 and 32 in FIG. 3. For L-shaped members 16 fabricated from aluminum, the deformation is permanent, and allows for an even greater build up of moisture, which in turn freezes and further deforms the corners 30 and 32. For L-shaped members 16 fabricated from plastic, the total deformation is not completely permanent, since the plastic corners 30 and 32 will partially deflect back to their original position after the ice melts. In any event, even though plastic corners 30 and 32 partially deflect back, a larger gap is provided for moisture build up, which in turn can freeze and permanently deform the corners 30 and 32 further.

As a result of being subjected to one or more moisture build-up and freezing cycle(s), the corners 30 and 32, whether fabricated from aluminum or plastic, assume a permanently deformed position which disrupts the end-to-end relationship of the L-shaped members which provides an unstable and unsightly finishing edge for construction panels 10 and overlying surface 22.

SUMMARY OF THE INVENTION

Accordingly, the present invention provides an improved construction panel support useable with an arrangement for supporting construction panels. The panel support includes a back flange and a support flange joined to the back flange. The support flange extends outward from the back flange at substantially 90 degrees and is adapted to support the construction panel. The back flange is adapted to attach the support to a structure in an end-to-end relationship with a second support member attached to the structure. The improvement in the panel support comprises means for preventing disruption of the end-to-end relationship.

BRIEF DESCRIPTION OF THE DRAWINGS

The preferred exemplary embodiment of the present invention will hereinafter be described in conjunction with the appended drawings, wherein like designations denote like elements, and.

DETAILED DESCRIPTION OF THE PREFERRED EXEMPLARY EMBODIMENT

Figure 4:
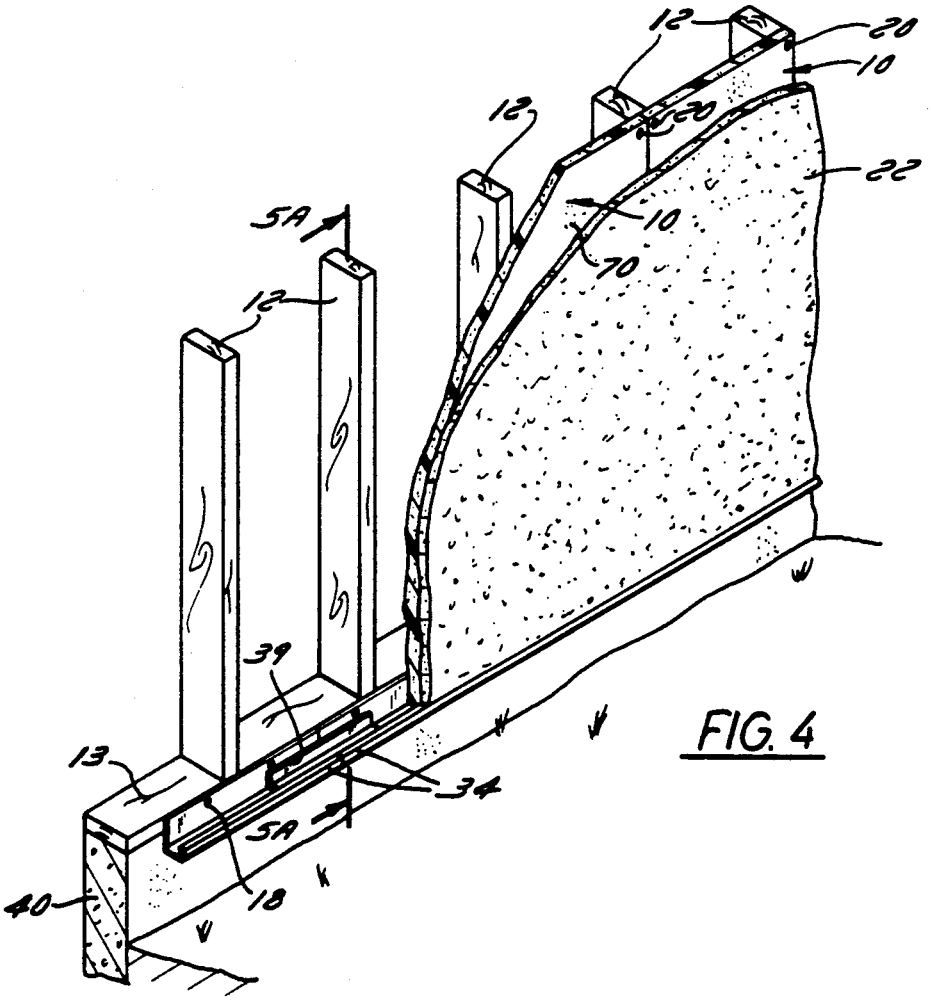
FIG. 4 illustrates an improved arrangement for supporting construction panels adjacent to a building structure.

The construction panel support arrangement, described in detail below, supports construction panels 10 adjacent to the structure of a building. The arrangement serves to support construction panels 10 while panels 10 are being affixed to the building structure, and also serves to provide a finished edge at selected edges of panels 10. Referring to FIG. 4, the components of the preferred exemplary embodiment of the support arrangement are shown. These components include adjacent L-shaped support members 34, fasteners 18, 20, and reenforcement members 38, 39. (Member 39 is not shown in FIG. 4.)

The building support structure disclosed herein is a wood frame structure, but the support arrangement can be used with other types of construction. Referring to FIGS. 4, 5A, 5B and 8, the framing for the building walls includes a 2-by-4 base 13 and 2-by-4 studs 12. Studs 12 are generally fastened to base 13 at 16 or 24 inch centers and extend vertically upwards from base 13. Base 13 is fastened to building foundation 40. In addition to the framing, the building walls can also include sheeting 42 (FIG. 5B) fastened to studs 12 and base 13. By way of example, sheeting 42 can be plywood, particle board, pressboard, etc.

L-shaped members 34 provide support for construction panels 10. L-shaped members 34 also provide finished edges at bottom edges 14 of construction panels 10 and bottom edge 15 of surface 22. Referring to FIGS. 5–9, L-shape members 34 include a back flange 44, a bottom flange 46, and a front side flange 48. Bottom flange 46 is joined at one side to back flange 44 and extends outwardly from back flange 44 at substantially 90 degrees. Due to the nature of the function of L-shaped members 34 it in not necessary that the angle between bottom flange 46 and back flange 44 be exactly 90 degrees.

Figure 12:
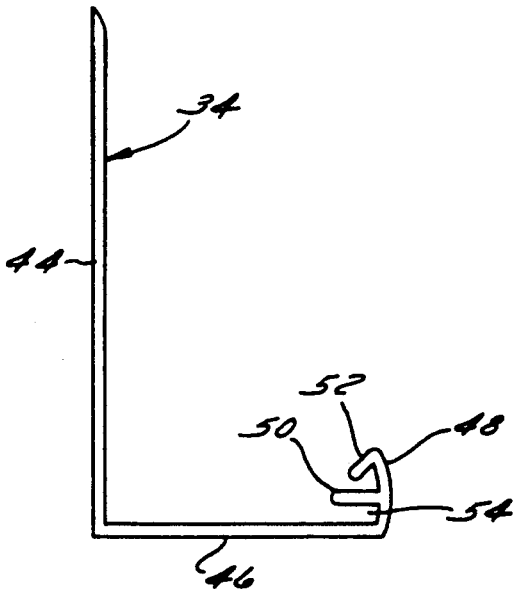
FIG. 12 is an enlarged end view of the L-shaped member.

Side flange 48 is joined to the other side of bottom flange 46 and extends upwardly from bottom flange 46 at substantially 90 degrees. It should be understood that it is not necessary that side flange 48 extend upwardly at 90 degrees, but it is presently the preferred configuration for the orientation of side flange 48. Side flange 48 is joined to a ridge 50 and a top flange 52. Referring to FIG. 12, the side flange 48 extends between bottom flange 46 and top flange 52. Top flange 52 extends from side flange 48 toward back flange 44, such that the angle between top flange 52 and side flange 48 is less than 90 degrees. Ridge 50 is joined to side flange 48 between bottom flange 46 and top flange 52. Ridge 50 extends from side flange 48 toward back flange 44 at substantially 90 degrees, such that space in the form of a groove or channel 54 is formed between ridge 50, side flange 48, and bottom flange 46. Ridge 50 extends from side flange 48 at a distance about two times the distance between ridge 50 and bottom flange 46.

By way of example, L-shaped members 34 can be fabricated from an extrusion molded polyvinyl chloride material to provide the configuration discussed above. In particular, one type of polyvinyl chloride which can be used to fabricate L-shaped members 34 is a weatherable exterior grade of the Geon vinyl compounds formulated by B. F. Goodrich for outdoor use. Furthermore, for certain applications, it may be desired to fabricate L-shaped members 34 from aluminum using an extrusion process.

Figure 13:
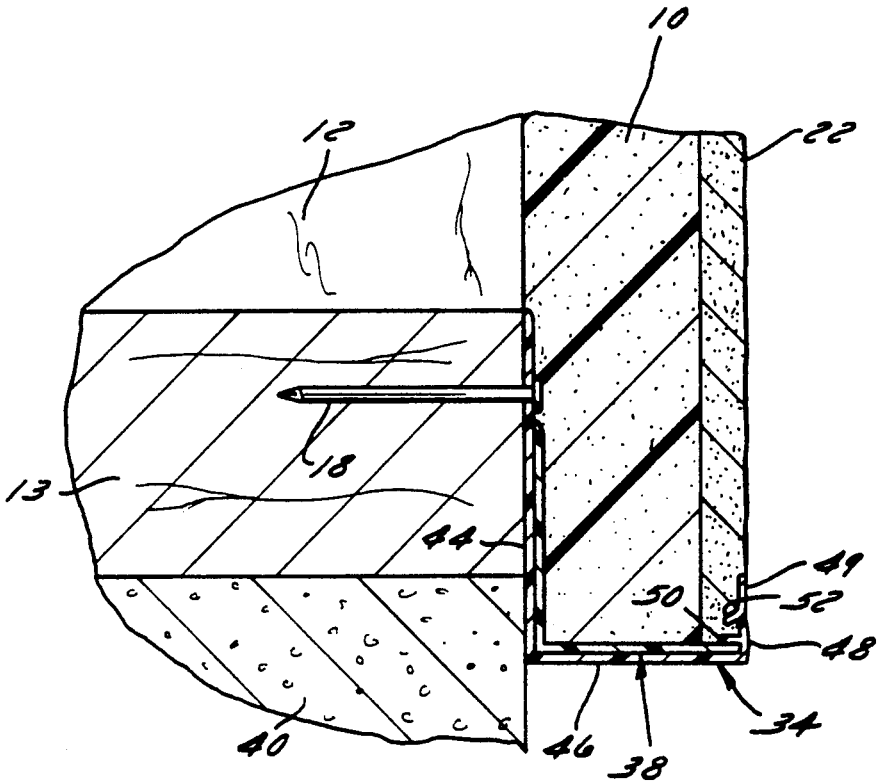
FIG. 13 is a side view of the improved arrangement including a modified L-shaped member.

FIG. 13 illustrates a modified L-shaped member, wherein side flange 48 extends from bottom flange 46 to top flange 52 and further extends beyond top flange 52 to form a lip 49. This configuration provides a slightly different interface between surface 22 and L-shaped member 34.

Figure 14:
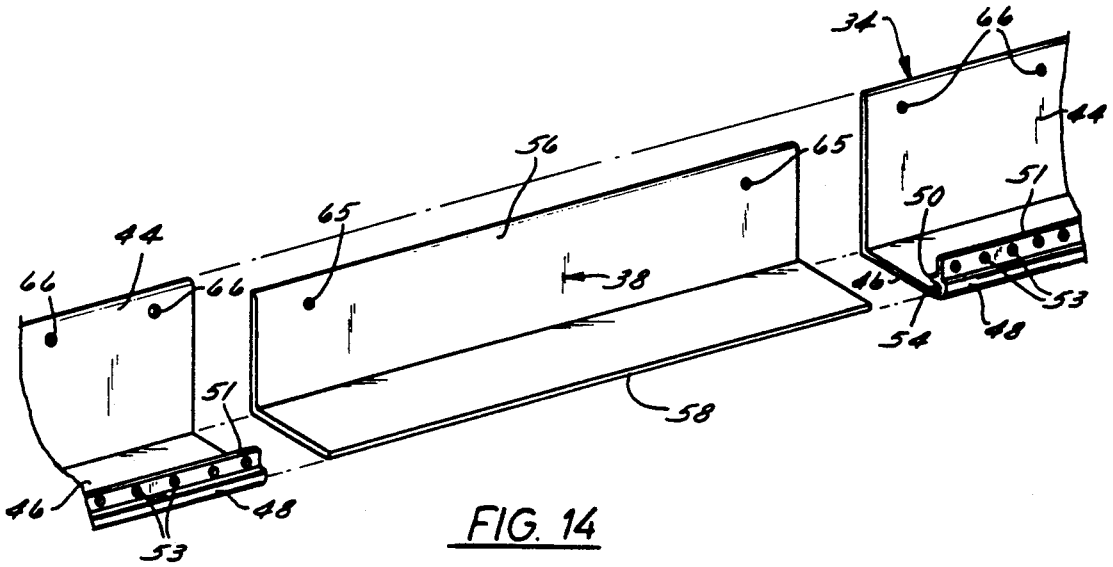
FIG. 14 is an exploded view of the improved arrangement for supporting construction panels including an modified L-shaped member.
Figure 15:
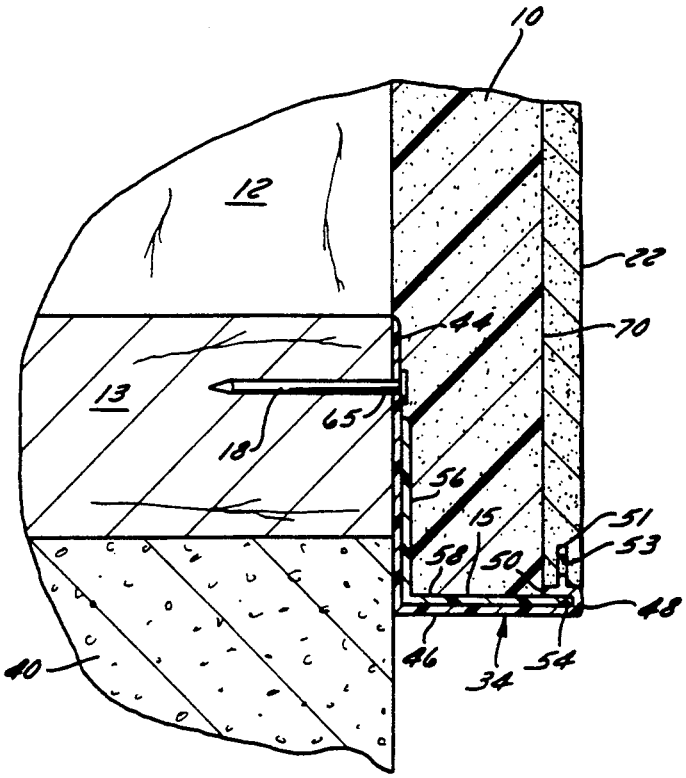
FIG. 15 is a side view of the improved arrangement including a modified L-shaped member.
Figure 16:
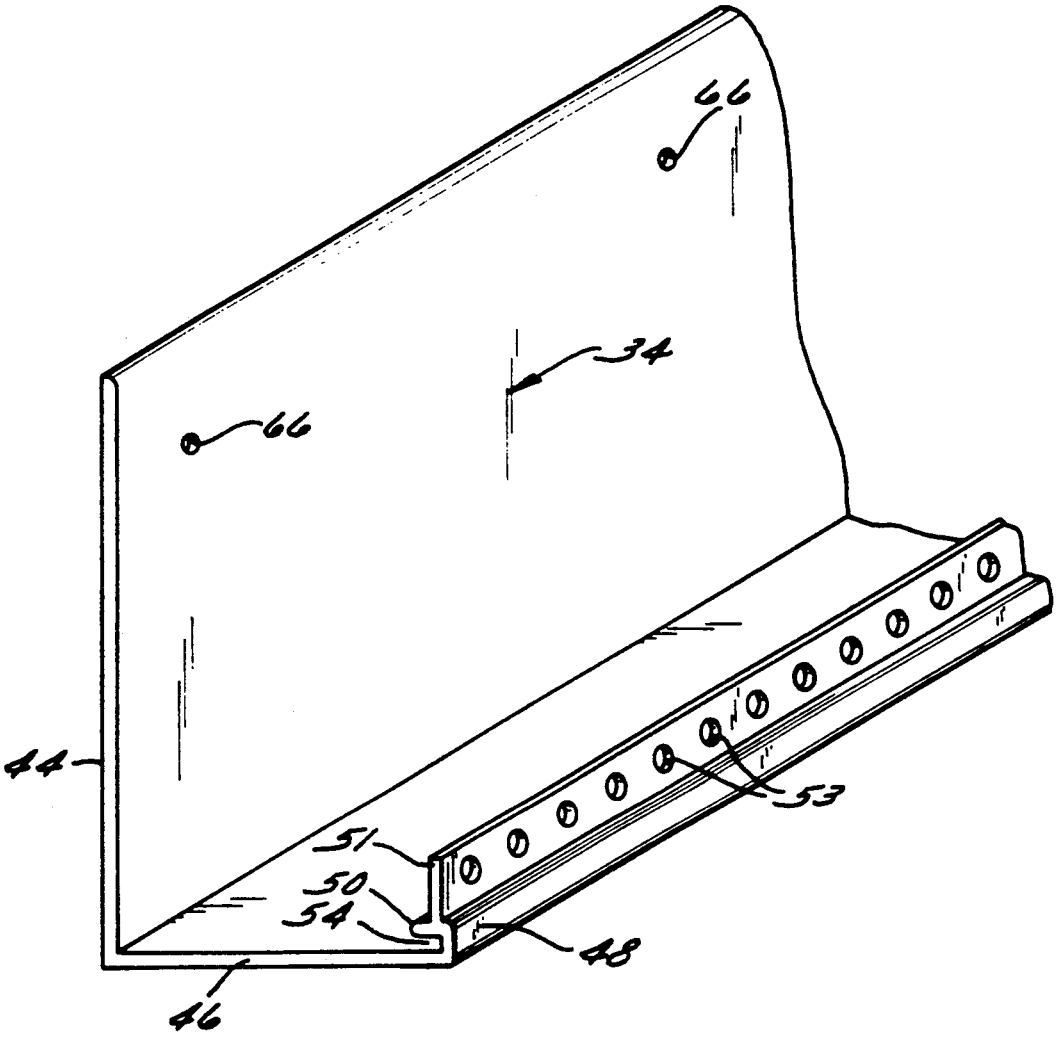
FIG. 16 is an exploded perspective view of a modified L-shaped member.

FIGS. 14, 15 and 16 illustrate another modified L-shaped member 34, wherein side flange 48 only extends from bottom flange 46 to ridge 50 to form groove 54. The modification includes a perforated flange 51 joined to ridge 50 and extending upwardly from the ridge 50. Perforated flange 51 is set back from the side flange 48 as illustrated in FIGS. 15 and 16. Perforated flange 51 includes a plurality of openings 53 adapted to engage the material of surface 22. The surface 22 may be produced using a surface material such as be mortar, plaster, stucco, or concrete. FIG. 15 illustrates the interaction between the surface material and the perforated flange 51. Depending upon the consistency of the surface material, when the surface material is applied to panel 10 it can flow, to some extent, into and engage openings 53. This interaction provides a good engagement between surface 22 and L-shaped members 34, and prevents surface 22 from separating from panels 10 at lower edges 15 of panels 10. Furthermore, this interaction strengthens the joints between L-shaped members 34.

Reenforcement members 38 (FIG. 6), 39 (FIG. 9) are configured to engage grooves 54 of L-shaped members 34 and maintain an end-to-end relationship between abutting L-shaped members 34. The first embodiment of the reenforcement member, reenforcement member 38, has a substantially L-shaped cross-section including a first leg 56 extending at substantially 90 degrees from a second leg 58. First leg 56 is adapted to rest against back flanges 44 of two abutting L-shaped members 34, and second leg 58 is adapted to lay upon bottom flanges 46 of the two abutting L-shaped members 34 and below panel 10, such that second leg 58 also engages grooves 54 of the abutting L-shaped members 34.

The second embodiment of the reenforcement member, reenforcement member 39, has a substantially L-shaped cross-section including a first leg 60 extending at substantially 90 degrees from a second leg 62 which is substantially longer than first leg 60. First leg 60 is adapted to lay upon bottom flanges 46 of the two abutting L-shaped members 34, such that first leg 60 also engages grooves 54 of the abutting L-shaped members 34. Second leg 62 is adapted to be attached to surface 70 (FIG. 8) and to include a plurality of engagement holes 64 having varying sizes.

As with the L-shaped members 34, reenforcement members 38, 39 can be extrusion molded from the weatherable exterior grade of the Geon vinyl compounds formulated by B. F. Goodrich for outdoor use. A difference between reenforcement members 38 and 39 is that engagement holes 64 must be punched into the reenforcement member 39. Accordingly, the reenforcement members 39 are substantially more expensive to fabricate. Furthermore, for certain applications, it may be desirable to fabricate the reenforcement members 38, 39 from aluminum using an extrusion process.

L-shaped members 34 are normally affixed to studs 12 (FIG. 8), base 13 (FIGS. 5A or 8) or sheeting 42 (FIG. 5B) of a building structure, but L-shaped members 34 could also be affixed to foundation 40. L-shaped members 34 are affixed to structure in an abutting end-to-end relationship, wherein the back flanges 44, the bottom flanges 46 and the side flanges 48 are aligned such that two abutting L-shaped members 34 appear as a single continuous L-shaped member. Typically, L-shaped members 34 are fabricated in 8, 10 or 12 foot sections to facilitate handling. Accordingly, many L-shaped members 34 will be joined in an end-to-end relationship to provide support for all of the panels 10 used in preparing the facade of a building.

Nails 18, screws 19, or adhesive 21 can be used to affix L-shaped members 34 to the building structure. To facilitate the use of nails 18 or screws 19, back flange 44 includes openings 66 adapted to accept nails 18 or screws 19.

Subsequent to affixing L-shaped members 34 to a building, a reenforcement member 38 or 39 is engaged with adjacent L-shaped members 34 at the locations where L-shaped members 34 abut. For applications where the added strength provided by reenforcement member 39 (see discussion below) is not needed, it is desirable to use the less expensive reenforcement member 38 to engage adjacent L-shaped members 34. When reenforcement members 38 are used, the members 38 are engaged with adjacent L-shaped members 34 and fastened to the structure with nails 17. The nails 17 pass through openings 65 in the members 38 and provide additional support for the L-shaped members 34 in the vicinity of the member 38. Subsequently, a panel 10 can be rested upon bottom flanges 46. Accordingly, a panel 10 will rest upon the reenforcement members 38 at locations where L-shaped members 34 abut.

When reenforcement members 39 are used, the members 39 are engaged with adjacent L-shaped members 34 after a panel 10 is rested upon bottom flanges 46. After a reenforcement member 39 is in place at a location where L-shaped members 34 abut, fasteners 68 are passed through engagement holes 64 such that fasteners 68 attach reenforcement member 39 to panel 10.

Figure 5A:
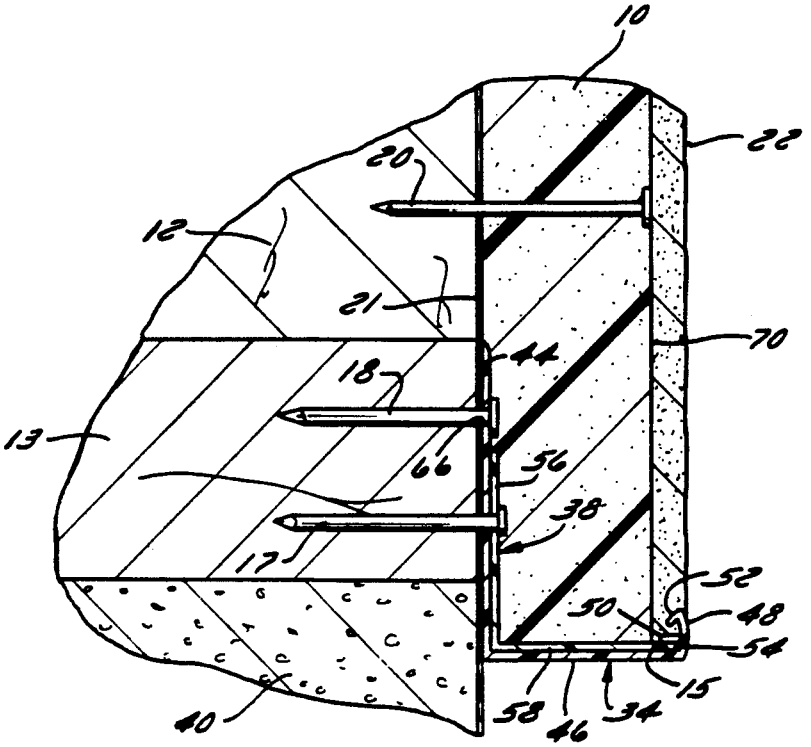
FIG. 5A is a sectional view taken along line 5A—5A in FIG. 4.
Figure 8:
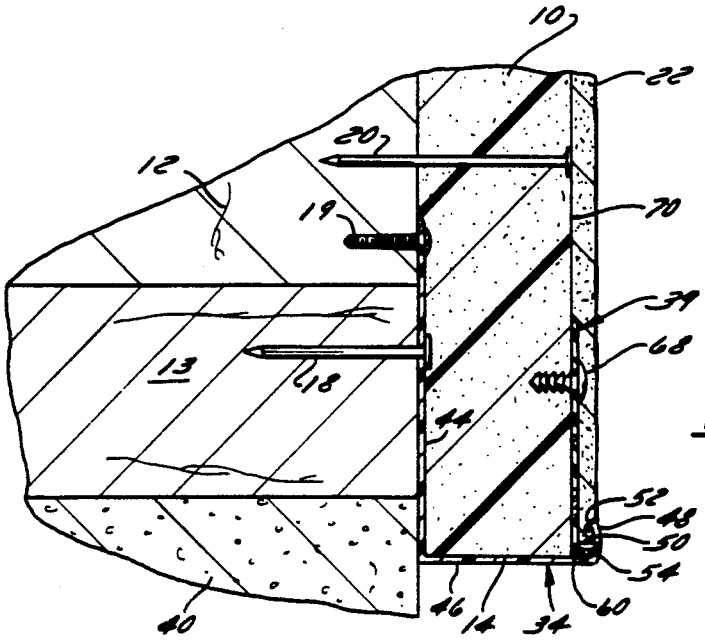
FIG. 8 is a sectional view taken along line 8—8 in FIG. 11.

Subsequent to supporting a desired group of panels 10 upon bottom flanges 46 and installing reenforcement members 38 or 39, panels 10 are affixed to the building structure with fasteners such as nails 20. After panels 10 are affixed in place, surface 22 is applied to panels 10. The surface 22 may be produced using a surface material such as be mortar, plaster, stucco, or concrete. Referring to FIGS. 5A and 8, the interaction between the surface material and top flange 52 is illustrated. When the surface material is applied to surface 70 of panels 10, the surface material is normally fluid enough to flow about and engage top flange 52. This interaction provides a finishing edge for the surface 22 and prevents surface 22 from separating from panels 10 at lower edges 15 of panels 10. Additionally, when reenforcement members 39 are used, the surface material engages engagement holes 64 to provide a strong composite structure at the joint between L-shaped members 34. This composite structure includes panel 10, reenforcement member 39, fastener 68, top flange 52 and surface 22. As discussed above, while the use of reenforcement member 38 is less expensive, it also does not provide a joint between L-shaped members 34 which is as strong as that provided with reenforcement member 39. This difference in strength is caused by the difference in structure between reenforcement members 38 and reenforcement members 39.

Figure 1:
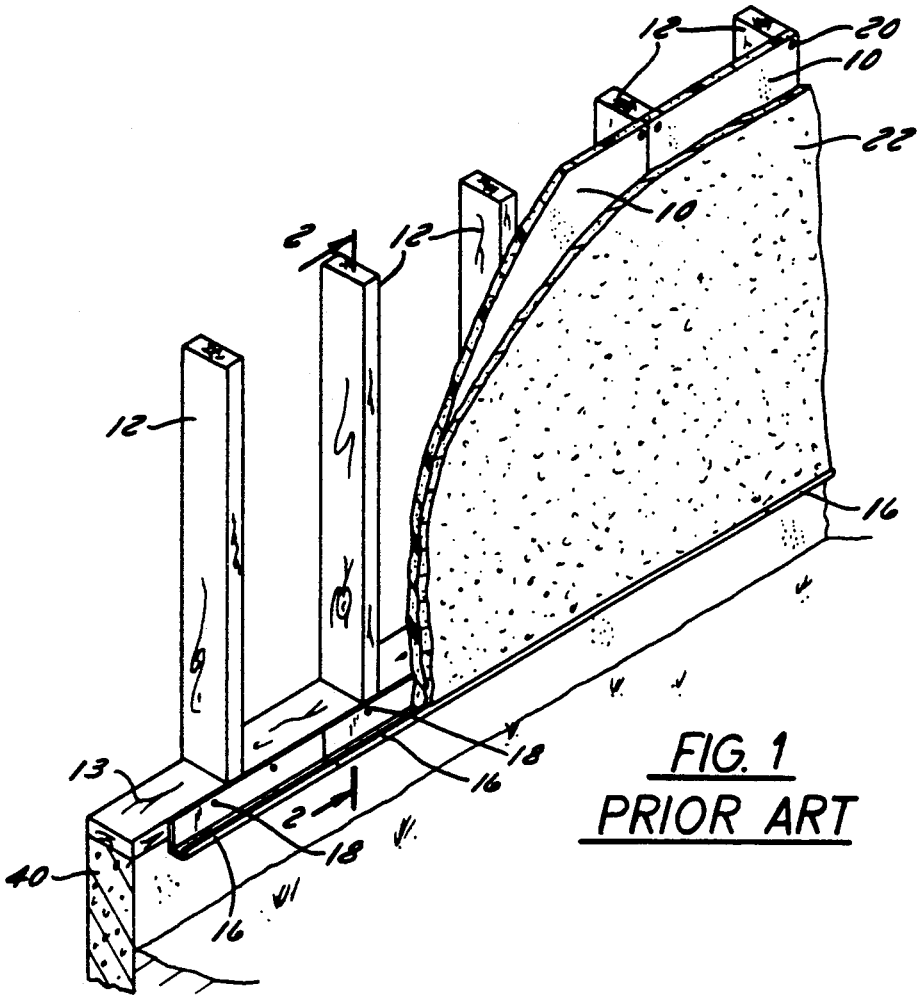
FIG. 1 PRIOR ART
FIG. 1 illustrates a prior art arrangement for supporting construction panels adjacent to a building structure.
Figure 2:
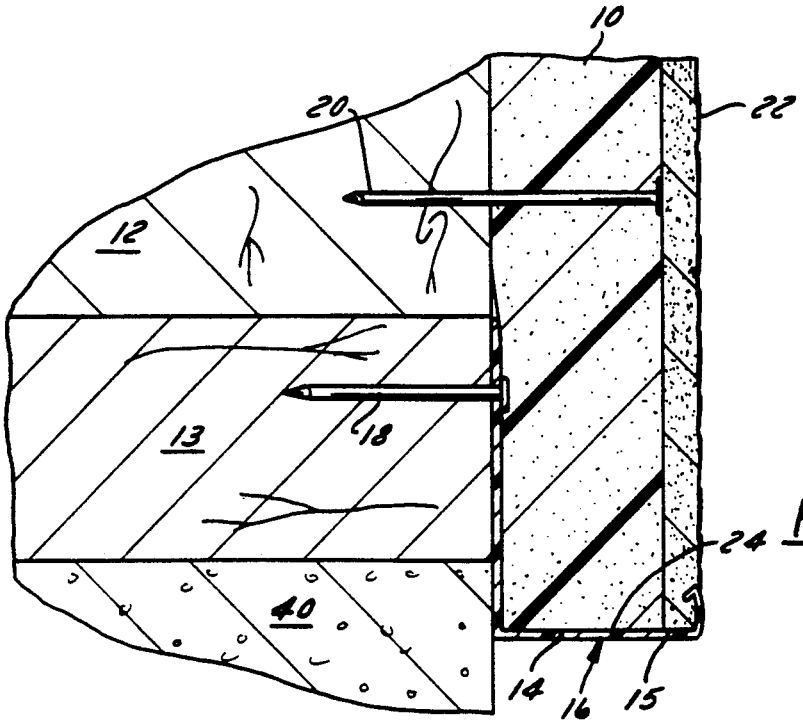
FIG. 2 PRIOR ART
FIG. 2 is a sectional view taken along line 2—2 in FIG. 1.
Figure 3:
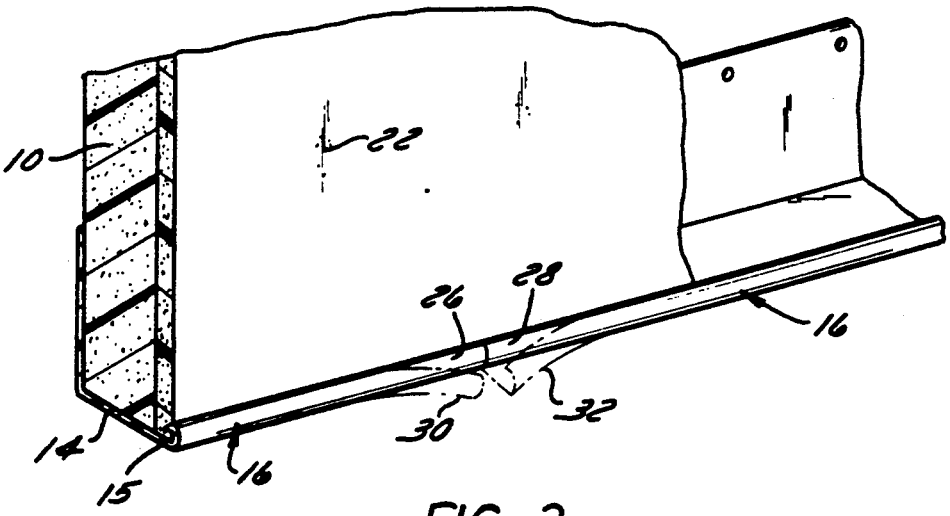
FIG. 3 PRIOR ART
FIG. 3 is a perspective view illustrating a disrupted end-to-end relationship between abutting L-shaped members.
Figure 5B:
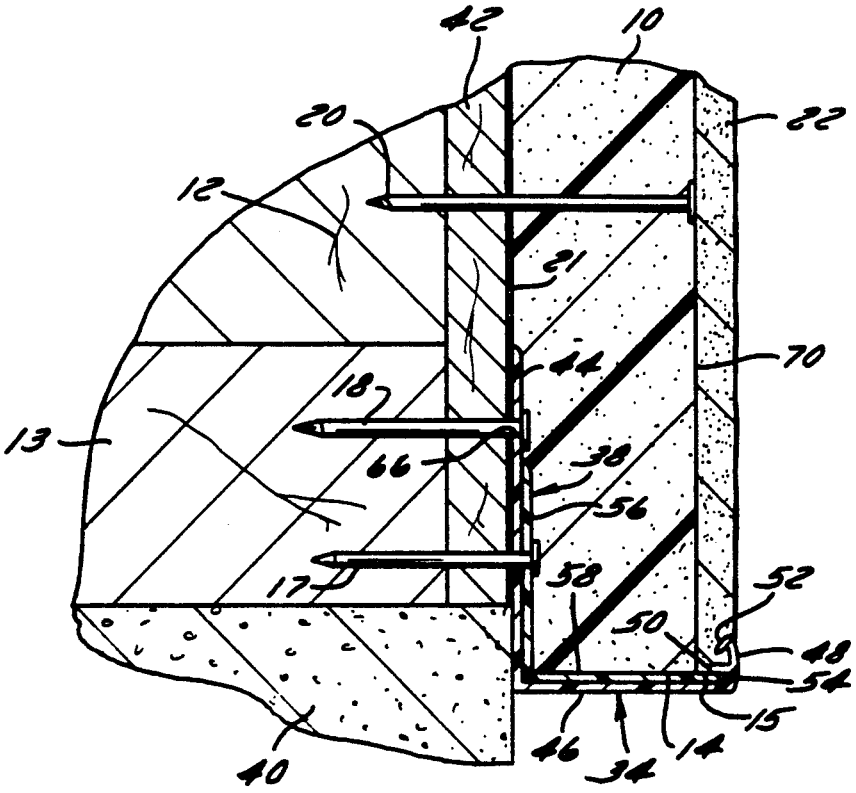
FIG. 5B is a modification of FIG. 5A, wherein sheeting is interposed between the framing and the construction panel.

Referring to FIGS. 3, the problem discussed above in reference to the joint between L-shaped members is that moisture builds up at the joint and freezing causes the moisture to break open the joint as illustrated in FIG. 3. Referring to FIGS. 5A and 8 respectively, the engagement of legs 58, 60 of reenforcement members 38, 39 and grooves 54 of L-shaped members 34 provides, in effect, a strengthening beam along side flanges 48 which spans the joint (weak location) between abutting L-shaped members 34. This strengthening effect provides a stronger joint which is resistant to breaking open in a manner similar to that shown in FIG. 3. Furthermore, when engagement member 39 is used, the composite structure (discussed above) formed at the joint provides further strength for purposes of resisting breakage at the joint.

Figure 6:
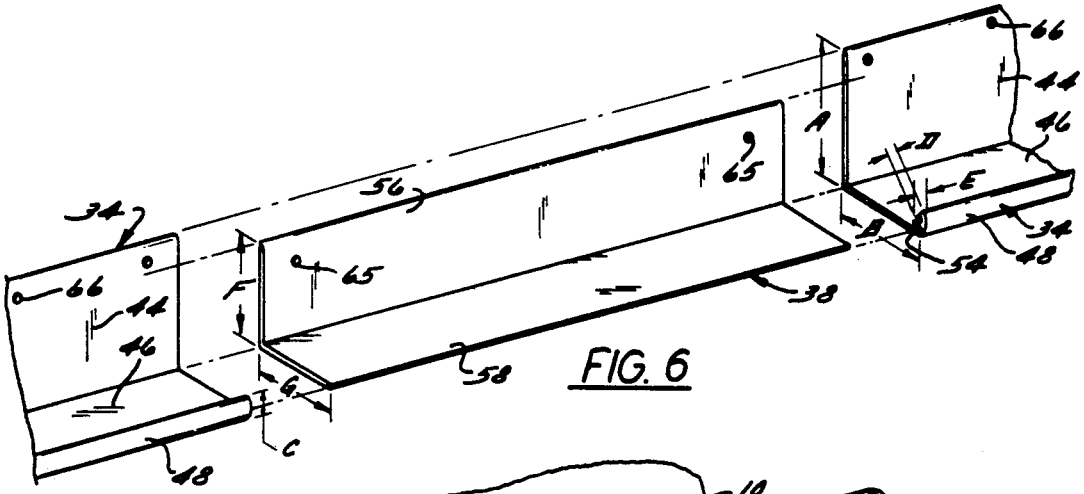
FIG. 6 is an exploded view of a first embodiment of the improved arrangement for supporting construction panels.
Figure 7:
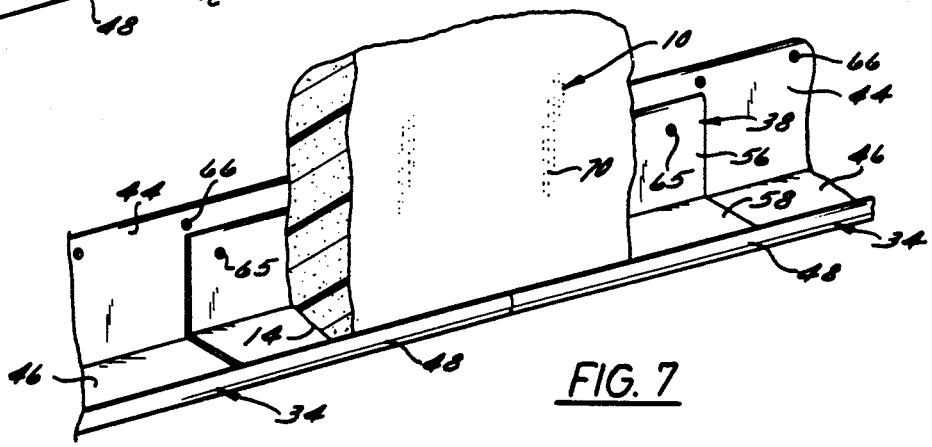
FIG. 7 is a perspective view of the first embodiment of the improved arrangement including a construction panel.
Figure 9:
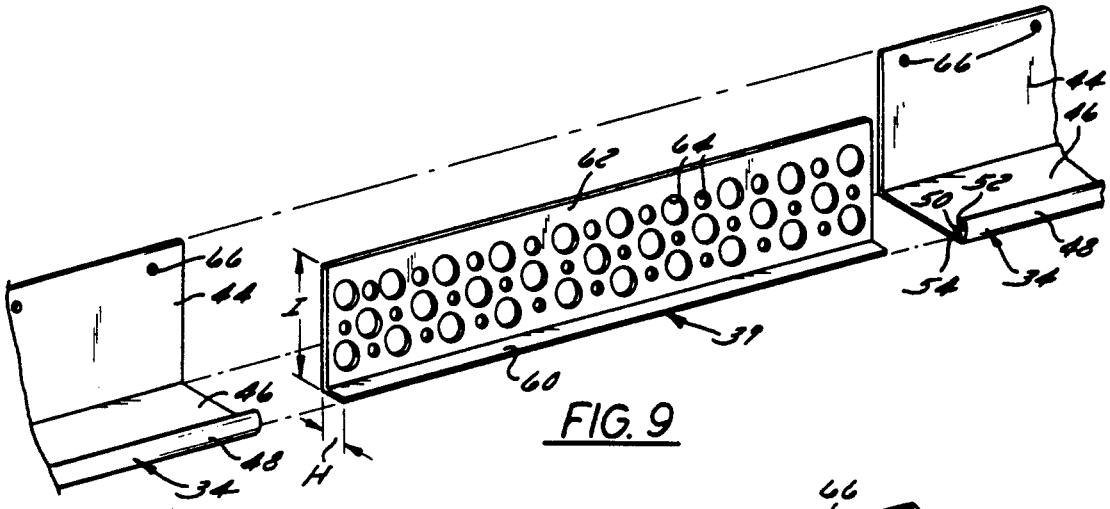
FIG. 9 is an exploded view of a second embodiment of the improved arrangement for supporting construction panels.
Figure 10:
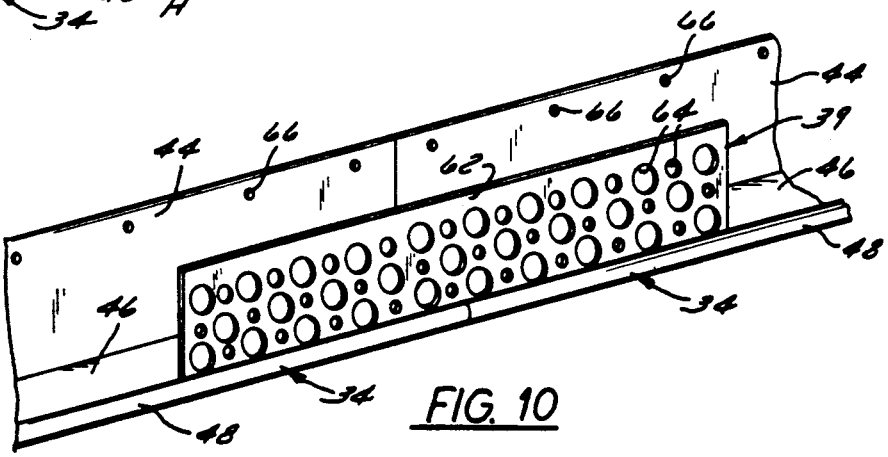
FIG. 10 is a perspective view of the second embodiment of the improved arrangement.
Figure 11:
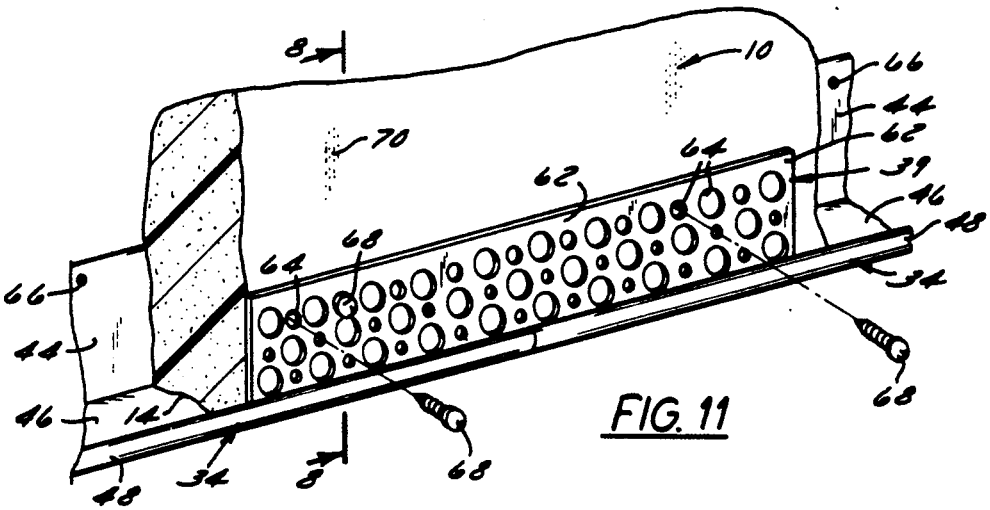
FIG. 11 is a perspective view of the second embodiment of the improved arrangement including a construction panel.

By way of example, to support 7/8ths inch thick panels 10 of foam insulation against a building, L-shaped members 34 having a 2 inch back flange 44, a 1.25 inch bottom flange 46, a 0.375 inch side flange 48, a 0.125 inch top flange 52, and a 0.125 inch ridge 50 are used. (FIG. 6, see dimension A-E respectively.) The thickness of flanges 44, 46, 48, 52, and ridge 50 is about 1/16 inch. Top flange 52 extends from side flange 48 at about 45 degrees, and ridge 50 extends from side flange 48 at about 90 degrees. A reenforcement member 38 having a 1.5 inch first leg 56 and a 1.125 inch second leg 58 (FIG. 6, see dimensions F and G respectively) can be used for reenforcing the joints between L-shaped members 34. If additional strength is needed at the joints between L-shaped members 34, a reenforcement member 39 having a 125 inch first leg 60 and a 1.75 inch second leg 62 can be used. (FIG. 9, see dimensions H and I respectively.) The engagement holes 64 are 3 sizes, large (0.375 inch diameter), medium (0.25 inch diameter), and small (0.125 inch diameter). The thickness of the flanges of the members 38, 39 is about 1/16 inch.

By way of a further example, for the modified L-shaped member 34 illustrated in FIGS. 14–16 a 3/16 inch ridge 50 can be used with a perforated flange 51 extending upwardly therefrom for about $\frac{3}{8}$ of an inch. Perforated flange 51 is set back from the side flange 48 by about $\frac{1}{8}$ inch. Perforated flanges 51 are about 1/16 inch thick and includes openings 53 having diameters of about 3/16 inch.

While one preferred exemplary embodiment of the support arrangement, and two preferred exemplary embodiments of the reenforcement member have been shown and described herein, the invention is not limited to the specific forms shown and described. For example, the L-shaped members and reenforcement members may be fabricated from materials other than aluminum or PVC. By way of another example, the panels 10 may be fabricated from an insulating foam or other material to which materials such as mortar, plaster, stucco, or concrete adhere. These and other modifications may be made in the design and arrangement of the elements within the scope of the invention, as expressed in the appended claims.

What is claimed is:

1. An improved construction panel support member of the type which includes a back flange and a support flange joined to the back flange, the support flange extending outward from the back flange at substantially 90 degrees and being adapted to support a panel, and the back flange being adapted for attaching the support member to a structure in an end-to-end relationship with a second support member attached to the structure, wherein forces disrupt the end-to-end relationship between the support members, the improvement comprising:

a channel joined to the support flange, the channel being engagable by a member engagable with the second support member.

2. The support member of claim 1, wherein the support members and the member engagable are fabricated from an extrusion molded material.

3. A construction panel support member for attachment to a structure in an end-to-end relationship with a second support member, the panel support member comprising:

a back flange attachable to the structure;

a bottom flange joined to the back flange at substantially 90 degrees, the bottom flange including a top surface adapted to support a construction panel; and a side flange joined to the bottom flange, the side flange being substantially parallel with the back flange and extending upwardly from the bottom flange to a top flange, the top flange being substantially parallel to the top surface and extending from the side flange toward the back flange, the side flange including a ridge being substantially parallel to the top surface and extending from the side flange toward the back flange such that a groove is formed between the top surface, the ridge, and the side flange, the groove being adapted to accept a support element engageable with the second support member.

4. The arrangement of claim 3, wherein the panel support member is fabricated from polyvinyl chloride.

5. The arrangement of claim 3, wherein the panel support member is fabricated from aluminum.

6. The arrangement of claim 3, wherein the top flange extends from the side flange such that the angle between the top flange and the side flange is less than 90 degrees.

7. The arrangement of claim 3, wherein the ridge extends from the side flange at substantially 90 degrees.

8. The arrangement of claim 3, wherein the top flange is adapted to engage a material disposed upon the surface of the construction panel.

9. The arrangement of claim 3, wherein the side flange extends beyond the top flange.

10. An arrangement for supporting a construction panel adjacent to the structure of a building, the system comprising:

a first L-shaped support member comprising;

a first back flange attachable to the structure;

a first bottom flange joined to the back flange at substantially 90 degrees, the first bottom flange including a first top surface adapted to support a construction panel; and a first side flange joined to the first bottom flange, the first side flange being substantially parallel with the first back flange and extending upwardly from the first bottom flange to a first top flange, the first top flange being substantially parallel to the top surface and extending from the first side flange toward the first back flange, the first side flange including a first ridge being substantially parallel to the first top surface and extending from the first side flange toward the first back flange, such that a first groove is formed between the first top surface, the first ridge, and the first side flange;

a second L-shaped support member comprising;

a second back flange attachable to the structure;

a second bottom flange joined to the back flange at substantially 90 degrees, the second bottom flange including a second top surface adapted to support the construction panel; and a second side flange joined to the second bottom flange, the second side flange being substantially parallel with the second back flange and extending upwardly from the second bottom flange to a second top flange, the second top flange being substantially parallel to the top surface and extending from the second side flange toward the second back flange, the second side flange including a second ridge being substantially parallel to the second top surface and extending from the second side flange toward the second back flange, such that a second groove is formed between the second top surface, the second ridge, and the first side flange;

means for affixing the first and second L-shaped members to the structure in an end-to-end relationship such that the first top surface is located within a plane and the second top surface located substantially within the plane; and means for engaging the first groove and the second groove and maintaining the first L-shaped member in the end-to-end relationship with the second L-shaped member.

11. The arrangement of claim 10, wherein the first and second L-shaped members are fabricated from polyvinyl chloride.

12. The arrangement of claim 10, wherein the first and second L-shaped members are fabricated from aluminum.

13. The arrangement of claim 10, wherein the first and second top flanges extend from the respective first and second side flanges such that the angle between the first and second top flanges and the respective first and second side flanges is less than 90 degrees.

14. The arrangement of claim 10, wherein the first and second ridges extend from the respective first and second side flanges at substantially 90 degrees.

15. The arrangement of claim 10, wherein the means for affixing comprises an adhesive.

16. The arrangement of claim 10, wherein the means for affixing comprises a plurality of nails.

17. The arrangement of claim 10, wherein the structure includes a frame, and the first and second L-shaped members are affixed to the frame.

18. The arrangement of claim 10, wherein the structure includes a frame covered with sheeting material, and the first and second L-shaped members are affixed to the sheeting material.

19. The arrangement of claim 10, wherein the structure includes a foundation, and the first and second L-shaped members are affixed to the foundation.

20. The arrangement of claim 10, wherein the means for engaging includes an engagement flange for engaging the first and second grooves such that the engagement flange is substantially parallel with the first and second side flanges.

21. The arrangement of claim 20, wherein the means for engaging includes a support flange joined to the engagement flange and is adapted to be interposed between the first and second back flanges, and the construction panel.

22. The arrangement of claim 20, wherein the means for engaging includes a support flange joined to the engagement flange, the support flange being adapted to be interposed between the first flange and the construction panel, the arrangement further comprising means for fixing the support flange to the construction panel.

23. The arrangement of claim 10, wherein the first and second top flanges are adapted to engage a material disposed upon the surface of the construction panel.

24. The arrangement of claim 10, wherein the first and second side flanges extend beyond the respective first and second top flanges.

25. An improved construction panel support assembly including a plurality of support members mounted in an end-to-end relationship on a support structure, each support member including a back flange, a support flange extending outwardly from the back flange for supporting a construction panel and a front side flange extending upwardly from the support flange, the front side flange including a top flange extending toward the back flange, the improvement comprising a ridge provided on the front flange in a spaced relation to the bottom flange and the top flange and a reinforcement member mounted on the bottom flange of adjacent support members and extending into the space between the ridge and the bottom flange to maintain the end-to-end relationship of adjacent support members.

26. A construction panel support member for attachment to a structure in an end-to-end relationship with a second support member, wherein the construction panel is of the type adapted to be coated with a surface material, the panel support member comprising:

a back flange attachable to the structure;

a bottom flange joined to the back flange at substantially 90 degrees, the bottom flange including a top surface adapted to support a construction panel;

a side flange joined to the bottom flange and extending upwardly from the bottom flange to a ridge, wherein the ridge is substantially parallel to the top surface and extends from the side flange toward the back flange such that a groove is formed between the bottom flange, the ridge and the side flange, the groove being adapted to accept a support element engageable with the second support member; and means for engaging surface material, wherein the means for engaging is joined to the ridge.

27. The support member of claim 26, wherein the means for engaging comprises a perforated flange extending upwardly from the ridge.

28. The support member of claim 27, wherein the means for engaging comprises an extension of the side flange extending upwardly to a top flange, the top flange extending from the extension toward the back flange.

* * * * *